US006618657B1

(12) United States Patent
Geil et al.

(10) Patent No.: US 6,618,657 B1
(45) Date of Patent: Sep. 9, 2003

(54) EMERGENCY CALL DEVICE FOR VEHICLES

(75) Inventors: Andreas Geil, Stuttgart (DE); Joerg Jehlicka, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/959,134

(22) PCT Filed: Apr. 14, 2000

(86) PCT No.: PCT/EP00/03375

§ 371 (c)(1),
(2), (4) Date: Feb. 14, 2002

(87) PCT Pub. No.: WO00/63867

PCT Pub. Date: Oct. 26, 2000

(30) Foreign Application Priority Data

Apr. 16, 1999 (DE) ..... 199 17 207

(51) Int. Cl.[7] ..... G08G 1/127
(52) U.S. Cl. ..... 701/45; 340/436
(58) Field of Search ..... 701/29, 45; 340/436, 340/989; 342/357.09, 357.1

(56) References Cited

U.S. PATENT DOCUMENTS

| | | | | | |
|---|---|---|---|---|---|
| 3,990,040 | A | * | 11/1976 | Gleitz et al. | 340/436 |
| 4,369,426 | A | * | 1/1983 | Merkel | 340/904 |
| 5,311,197 | A | * | 5/1994 | Sorden et al. | 342/457 |
| 5,933,080 | A | * | 8/1999 | Nojima | 340/539 |
| 6,076,028 | A | * | 6/2000 | Donnelly et al. | 701/45 |
| 6,339,370 | B1 | * | 1/2002 | Ruhl et al. | 340/436 |
| 6,377,165 | B1 | * | 4/2002 | Yoshioka et al. | 340/425.5 |
| 6,377,169 | B1 | * | 4/2002 | Yanagisawa | 340/504 |

FOREIGN PATENT DOCUMENTS

| | | |
|---|---|---|
| DE | 44 21 508 | 12/1994 |
| DE | 43 21 416 | 1/1995 |
| DE | 197 44 602 | 4/1998 |

* cited by examiner

*Primary Examiner*—Michael J. Zanelli
(74) *Attorney, Agent, or Firm*—Kenyon & Kenyon

(57) ABSTRACT

An emergency call device that transmits a distress message independently of damage to the vehicle electronic system, where the emergency call device transmits a first message, which contains at least the geographical location of the vehicle, when sensors detect a critical driving situation, even before an accident has actually occurred.

10 Claims, 1 Drawing Sheet

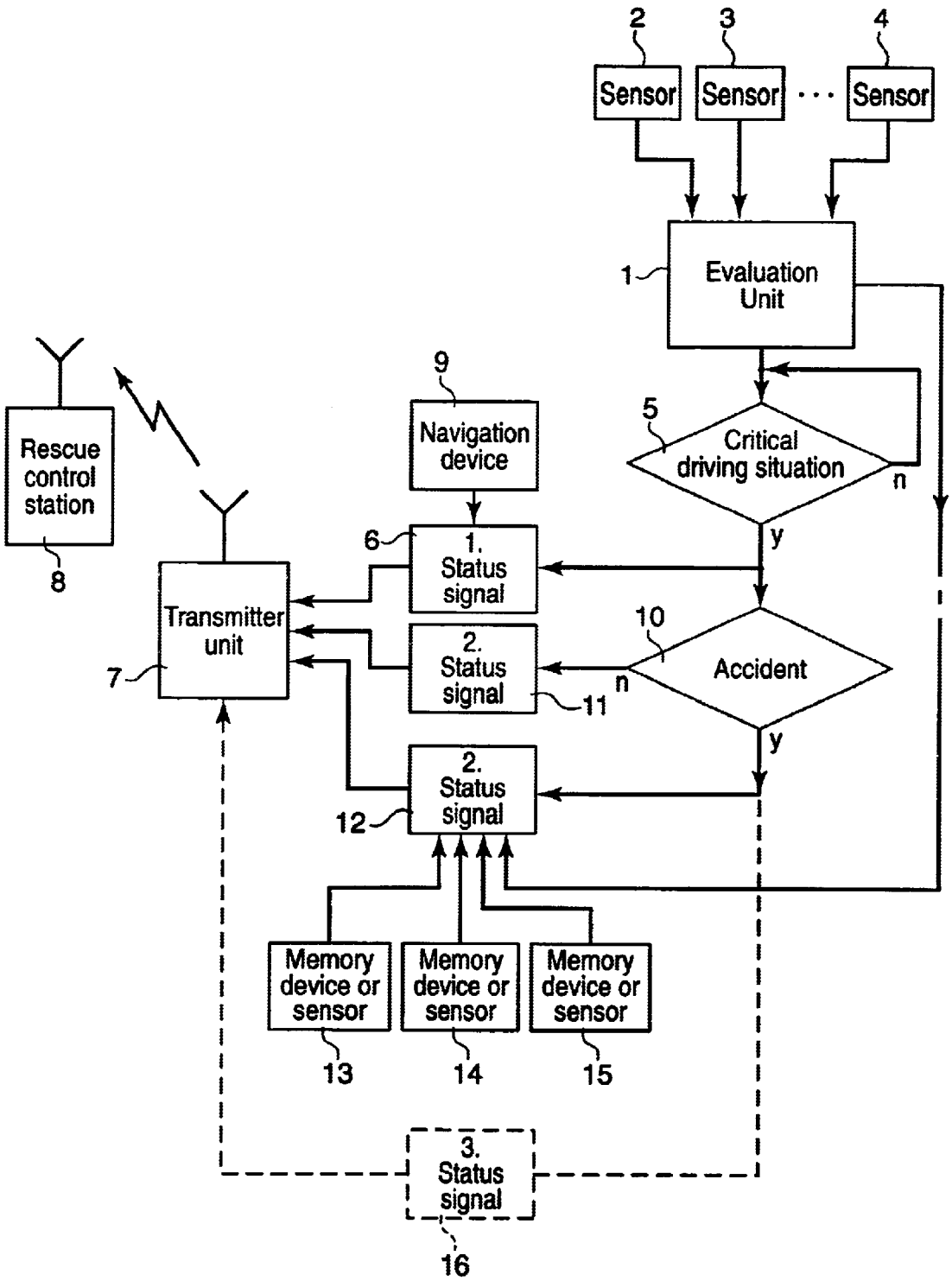
2
3
4
Sensor
Sensor
Sensor
1
Evaluation Unit
9
Navigation device
5
Critical driving situation
n
y
Rescue control station
8
6
1. Status signal
Transmitter unit
7
10
2. Status signal
11
n
Accident
y
2. Status signal
12
Memory device or sensor
Memory device or sensor
Memory device or sensor
13
14
15
3. Status signal
16

EMERGENCY CALL DEVICE FOR VEHICLES

FIELD OF THE INVENTION

The present invention relates to an emergency call device for vehicles, which transmits a distress message to a rescue control station in the event of an accident detected by the sensors in the vehicle, the distress message containing information suitable for initiating emergency measures.

BACKGROUND INFORMATION

An emergency call device described in German Patent No. DE 44 21 508, for example, renders it possible to quickly provide aid to vehicle occupants affected by an accident. Even if the a vehicle occupants are no longer capable of calling for help themselves, the emergency call device automatically informs rescue services about the accident. In this context, the geographical location of the affected vehicle is automatically communicated to a rescue control station, and a plurality of other pieces of information can be transmitted to the rescue control station, thereby making it possible for the rescue services to initiate appropriate rescue measures. A significant problem of an automatic emergency call device is that, in many traffic accidents, the vehicle electronic system of the vehicle suffers or fails completely, thereby rendering it impossible to transmit a distress message to a rescue control station.

German Published Unexamined Application DE 43 21 416 A1 describes an emergency radio-communication system for a vehicle that transmits an emergency call in the event that a crash sensor detects an accident, the instantaneous position data of the vehicle being transmitted with the emergency call. Since the crash sensor detects an accident on the basis of predefined accident criteria, vehicle speed and accelerated braking being accident criteria, one can read precrash conditions therefrom.

SUMMARY

An object of the present invention is to provide an emergency call device of the type defined at the outset that reliably ensures that a distress message is transmitted to a rescue control station even if the vehicle electronic system is destroyed by the accident.

This object is achieved in that, in the event that the sensors in the vehicle detect a critical driving situation, the emergency call device transmits a first message containing at least the geographical location of the vehicle, even before an actual accident has occurred. As a result of a distress message being prophylactically transmitted when a critical driving situation is detected, even before the vehicle is destroyed, the rescue control station receives information about the geographical location of a vehicle that has a high probability of crashing and that will necessitate assistance.

If the critical driving situation does not subsequently result in an accident, it may be advantageous to inform the rescue control station via a second message sent after the conclusion of a predefined time span after the first message that the first message is invalid. If the vehicle electronic system is not completely destroyed upon the occurrence of an actual accident so that an additional message can be transmitted, the rescue control station receives further information suitable for initiating rescue measures via a second transmitted message. If a second message is not received by the rescue control station within a predefined time period after the first message, this means that an accident did, in fact, occur, consequently destroying the emergency call device.

Sensors can be present that detect translational acceleration and/or angular acceleration of the vehicle and/or changes in the shape of the vehicle body and/or braking operations and/or steering motions. An evaluation unit uses threshold value decisions to derive from the sensor signals whether a critical driving situation exists, and whether a critical driving situation resulted in an accident.

The second message may include information regarding the vehicle identification number and/or the vehicle make and/or the severity of the accident and/or the number of vehicle occupants and/or acute illnesses of the vehicle occupants.

After the second message, at least one additional message can be transmitted including even more detailed information about the manner in which the accident occurred and/or the position of the affected vehicle occupants, since the more information the rescue control station receives, the more deliberate and effective the initiation of rescue measures can be.

BRIEF DESCRIPTION OF THE DRAWING

The FIGURE shows a flow chart of an emergency call device it present in a motor vehicle, in accordance with an example embodiment of the present invention.

DETAILED DESCRIPTION

Today, most vehicles are already equipped with restraining devices, such as airbags, belt tighteners, and the like, to protect vehicle occupants from injury in the event of a crash. Sensors that measure the translational acceleration and/or angular acceleration of the vehicle control the triggering of these restraining devices. Thus, a critical driving situation that could possibly lead to a crash can be detected using such sensors. Critical driving situations can also be detected by sensing braking operations and/or steering motions.

The emergency call device has an evaluation unit 1, to which the output signals of sensors 2, 3, 4 of the specified type are conveyed. The evaluation unit 1 uses threshold value decisions to determine from the sensor signals whether a critical driving situation exists, and whether a critical driving situation resulted in an accident. If, as indicated in block 5, the evaluation in block 1 yields that a critical driving situation exists, a first message is emitted in accordance with block 6 to a transmitter unit 7, which transmits this message to a rescue control station 8. This first message 6 includes at least information regarding the geographical location of the vehicle in a critical driving situation. The geographical position of the vehicle is provided by a navigational device 9 installed in the vehicle, e.g., a global positioning system (GPS) receiver.

If the critical driving situation does not result in an accident, as query 10 indicates, transmitter unit 7 emits a second message 12 within a subsequent time span $\Delta t$. This second message 12 includes the information for rescue control station 8 that no accident occurred, thereby rendering the prophylactically transmitted first message 6 invalid. However, if query 10 yields that the critical driving situation did result in an accident time span $\Delta t$, a second message 12 is transmitted via transmitter unit 7. Included in this second message 12 can be detailed information enabling the rescue control station to initiate rescue measures in a more targeted manner. Blocks 13, 14, and 15 symbolize memory devices or sensors that provide the information for second message 12. This information can, for example, be the vehicle identification number, the vehicle make, the number of vehicle occupants, perhaps acute illnesses of vehicle occupants, etc. Information regarding the severity of the accident, as determined by evaluation unit 1, can also be included in second message 12.

It may be useful for the rescue control station for one or more additional messages to be transmitted after the accident that include more detailed information regarding the manner in which the accident occurred and the extent of the injuries and the state of the vehicle. Such a third message 16 is indicated in the drawing by a dashed line.

Messages 11, 12, and 16 can also be supplemented by information input by the vehicle occupants, provided that they are still capable of doing so.

If a second message 11 or 12 does not follow time span $\Delta t$ after a first transmitted message 6, this means for the rescue control station that an accident has occurred, the vehicle is no longer capable of transmitting a second message, and, therefore, rescue measures must be introduced.

If the vehicle is also equipped with a receiving unit, the rescue control station can also initiate visual or acoustic contact with the vehicle occupants.

What is claimed is:

1. An emergency call device for a vehicle, the vehicle including a sensor, comprising:

a transmitter configured to transmit a first message when the sensor detects a critical driving situation prior to an accident by comparing a signal from the sensor to a threshold value, the sensor detecting at least a braking operation, the first message containing at least a geographical location of the vehicle, the transmitter further configured to transmit a second message after a conclusion of a preselected time span after the first message is transmitted, the second message one of declaring the first message to be invalid in the event that the sensor did not detect the accident within the preselected time span, and containing further information suitable for initiating emergency measures in a case of an actual detected accident.

2. The emergency call device according to claim 1, wherein the sensor further detects at least one of translational acceleration, angular acceleration of the vehicle, changes in the shape of the vehicle body, and steering motions, and wherein the emergency call device further comprises:

an evaluation unit that uses threshold value decisions to derive from the signal from the sensor whether the critical driving situation exists, and whether a critical driving situation resulted in an accident.

3. The emergency call device according to claim 1, wherein the further information includes at least one of a vehicle identification number, a vehicle make, severity of the accident, number of vehicle occupants, and acute illnesses of the vehicle occupants.

4. The emergency call device according to claim 1, wherein the transmitter is configured to transmit at least one additional message after the second message containing further information, the at least one additional message containing further detailed information regarding at least one of a manner in which the accident occurred, and a position of affected vehicle occupants.

5. The emergency call device according to claim 1, wherein the first message is transmitted prior to the occurrence of the accident.

6. The emergency call device of claim 1, further comprising:

a navigational device to determine the geographical location of the vehicle.

7. The emergency call device of claim 6, wherein the navigational device includes a global position system receiver.

8. A method for transmitting an emergency call for a vehicle, comprising:

detecting a critical driving situation prior to an accident by comparing a signal from a sensor to a threshold value, the sensor detecting at least a braking operation;

after detecting the critical driving situation, transmitting a first message containing at least a geographical location of the vehicle; and after a preselected time span after the first message is transmitted, transmitting a second message, the second message one of: declaring the first message to be invalid in the event the accident is not detected within the time span, and containing further information suitable for initiating emergency measures in a case of an actual detected accident.

9. The method according to claim 8, further comprising:

transmitting a third message after transmitting the second message, the third message containing information regarding at least one of a manner in which the accident occurred, and a position of affected vehicle occupants.

10. The method according to claim 9, further comprising:

supplementing one of the first, second, and third messages with information input by a vehicle occupant.

* * * * *